US007585266B2

(12) United States Patent
Baner et al.

(10) Patent No.: US 7,585,266 B2
(45) Date of Patent: Sep. 8, 2009

(54) METHODS FOR PRODUCING AND USING CONTAINERS FOR HOUSING PRODUCT

(75) Inventors: Albert L. Baner, Wildwood, MO (US); Timothy M. Gleason, Manchester, MO (US)

(73) Assignee: Nestec S.A., Vevey (CH)

( * ) Notice: Subject to any disclaimer, the term of this patent is extended or adjusted under 35 U.S.C. 154(b) by 170 days.

(21) Appl. No.: 11/799,666

(22) Filed: May 2, 2007

(65) Prior Publication Data

US 2007/0201770 A1 Aug. 30, 2007

Related U.S. Application Data

(63) Continuation-in-part of application No. 11/387,332, filed on Mar. 23, 2006, which is a continuation of application No. 10/390,959, filed on Mar. 18, 2003, now Pat. No. 7,217,032, which is a continuation of application No. 09/941,049, filed on Aug. 28, 2001, now Pat. No. 6,604,857.

(60) Provisional application No. 60/228,581, filed on Aug. 29, 2000.

(51) Int. Cl.
*B31B 47/02* (2006.01)
*B31B 49/00* (2006.01)
*B65D 33/06* (2006.01)

(52) U.S. Cl. ..... 493/267; 493/480; 493/186; 383/6

(58) Field of Classification Search ..... 53/447, 53/477, 484; 493/53, 87, 133, 156, 480, 493/267; 383/6, 16, 32, 93, 98
See application file for complete search history.

(56) References Cited

U.S. PATENT DOCUMENTS

| | | | | | |
|---|---|---|---|---|---|
| 644,038 | A * | 2/1900 | Whalley | 383/12 |
| 2,128,904 | A * | 9/1938 | Belcher | 383/98 |
| 2,212,390 | A * | 8/1940 | Conklin | 383/2 |
| 2,454,013 | A * | 11/1948 | Scherzinger | 383/2 |
| 2,481,380 | A * | 9/1949 | Anderson, Sr. | 229/5.82 |
| 2,802,617 | A * | 8/1957 | Roper | 383/98 |

(Continued)

*Primary Examiner*—Paul R Durand
(74) *Attorney, Agent, or Firm*—Michael A. Beckett; Wendell Ray Guffey

(57) ABSTRACT

A flexible container and method for making and using same are provided. In an embodiment, the container comprises a base portion including a bottom, side walls, and an interior, the bottom defining a substantially flat planar surface when the container houses product and the container rests on its bottom, an upper panel portion, that is designed to be received within the interior of the base portion and includes side panels that define a closure member, the upper panel being so constructed and arranged to define a substantially flat surface when the closure member is closed and portions of the upper panel are folded over, the upper panel includes a portion that is sealed to the base portion, and a pair of handles may also be coupled to the base portion. The container provides improved methods of filling, sealing, handling, transporting, and merchandising the container.

10 Claims, 5 Drawing Sheets

U.S. PATENT DOCUMENTS 3,229,741 A * 1/1966 Ambrose ..... 383/2
4,581,873 A * 4/1986 Knuppertz et al. ..... 53/374.8
5,214,905 A * 6/1993 Wyberg ..... 53/477
5,255,494 A * 10/1993 Doyle ..... 53/477
5,285,955 A * 2/1994 Mosse ..... 229/137
5,326,575 A * 7/1994 Spaulding ..... 426/87
5,392,589 A * 2/1995 Buchanan ..... 53/412
5,518,578 A * 5/1996 Persells et al. ..... 156/580.1
5,564,255 A * 10/1996 Giacomelli ..... 53/371.2
5,890,347 A * 4/1999 Giacomelli et al. ..... 53/477
6,604,857 B2 * 8/2003 Buchanan et al. ..... 383/6
7,217,032 B2 * 5/2007 Buchanan et al. ..... 383/6

* cited by examiner

METHODS FOR PRODUCING AND USING CONTAINERS FOR HOUSING PRODUCT

RELATED APPLICATIONS

This continuation-in-part application claims the benefit of U.S. patent application Ser. No. 11/387,332, filed on Mar. 23, 2006, which is a continuation of U.S. patent application Ser. No. 10/390,959, filed on Mar. 18, 2003, now U.S. Pat. No. 7,217,032 which is a continuation of U.S. patent application Ser. No. 09/941,049, filed on Aug. 28, 2001, now U.S. Pat. No. 6,604,857, which claims priority from U.S. Provisional Application No. 60/228,581, filed on Aug. 29, 2000, the entire disclosures of which are incorporated herein by reference.

BACKGROUND

The present invention relates generally to containers for housing a product. More specifically, the present invention relates to methods of producing and using flexible containers for housing products.

There are a variety of types of containers for housing products. It is, of course, known to package products in rigid containers such as metal cans, glass bottles, or rigid plastic containers. Rigid containers, when empty, represent a high volume of empty space. As a result, rigid empty containers are cumbersome to ship to the destinations where they will be filled and sealed with product. In addition, such empty containers require significant space for storing and discarding.

It is also known to construct containers from flexible materials, such as sheets or rolls of plastic material. Such flexible containers have been in existence for a number of years. These containers offer many advantages over rigid containers. For example, flexible plastic bottles and cartons offer distinct advantages over metallic cans and glass bottles. In this regard, such flexible containers are lighter, typically far less expensive to produce, and much easier to discard.

However, there are inherent disadvantages with flexible containers. For example, flexible containers do not have the sturdiness of typical rigid containers. The sturdiness of the container can become an issue with respect to the stability of the container when they are filled with product and stood upright for storage, display, or other purpose. Moreover, heavier flexible containers are difficult to pick up and carry conveniently.

To overcome this stability issue, flexible containers have been formed with reinforced bottoms or sides. Such a container is shown in U.S. Pat. No. 5,135,464. In order to create such reinforced enforcements, layers of plastic film or paper are doubled in select locations along or adjacent to the container bottoms as they are manufactured. These double layers are fused by a heat sealing or stitching process. Such constructions, however, result in multiple layers of films or paper being brought together at junctions. In this regard, as many as six layers often meet and are interfused at a seam or junction. This multi-wall construction results in seals that possess a tendency to leak due to capillary action.

An additional problem with many flexible containers is that there is a lack of consistency in the production process. Typically, the manufacturing process associated with such products requires a web of film to be drawn through a series of forming stations where various folds, cuts, or seals are made to the film. In many of these manufacturing processes it is difficult to control and ensure the accuracy and consistency of the resultant product given the number of manipulations to the film and the number of folding, sealing and forming stations. In addition, there are hermetic sealing problems with the multi-wall bags presently available. To this extent, the bags are not "insect-tight" causing problems when the containers are stored with product. Also, the containers are not resealable for storage in-between uses.

A still further problem with flexible containers is their propensity to burst open. This is especially an issue should the container be dropped.

Moreover, another issue with such containers is their shape. Due to the flexible nature of the containers, the containers will take on the shape of the product contained therein and/or a bag-like shape. This makes it difficult to store the filled containers, stack same, and/or package the containers for shipping. Generally, the multi-layer bags have to be stored and displayed in a horizontal flat condition making it difficult to handle the bags. Moreover, it is also difficult to see the labeling on the bags when they are piled on top of each other in the horizontal flat condition.

The lack of stability also causes problems for the user when the user is trying to scoop or pour product from the bag.

Another problem with the current flexible bags is that they are not easily transported after the bags are filled with product at the distribution center or the manufacturing plant or after the filled bags arrive at the point of purchase location. Generally, packaged products are transported via conveyor systems at the manufacturing plant or point of purchase location. Often times, the conveyor systems include sharp turns (e.g., 90° turns) and gaps. The poor stability and awkward size of the large multilayer bags cannot maneuver around the turns or through the gaps. As a result, the large multi-layer bags cannot be transported on conveyor systems like other packaged products, they must be handled by hand.

There therefore is a need for an improved flexible container for storing and carrying a product, conveniently opening and closing the container and method for making such containers.

SUMMARY

Improved containers and methods for making same are provided. The improved container provides a flexible container that has sufficient stability to be used to house a product. At the same time, the container of the present invention provides desired flexibility. Moreover, the present invention provides improved methods of using containers, including the filling, sealing, handling, transportation, and merchandising of same.

To this end, in an embodiment, the present invention provides a method for improving the design of a pet food container as compared to a conventional pet food container comprising the steps of increasing a fill speed of the pet food container during the manufacturing process as compared to a fill speed of a conventional process; providing the pet food container with a greater volume utilization as compared to the conventional pet food container; and providing the pet food container with the ability to be sealed using a smooth sealing jaw during the manufacturing process.

In an embodiment, the fill speed is increased, at least in part, by increasing an opening of the pet food container as compared to a similar opening in the conventional pet food container. For example, the fill speed is increased, at least in part, by providing the pet food container with a flat bottom.

In an embodiment, the method of providing the pet food container with greater volume utilization is achieved by providing a bottom gusseted container.

In an embodiment, the pet food container does not have side gussets.

In an embodiment, the ability to be sealed with smooth jaws is achieved, at least in part, by providing the pet food container with a relatively consistent material thickness.

In an embodiment, the pet food container in an unfilled condition is so constructed and arranged so that a plurality of pet food containers lay flatter on a filling machine than a similar number of conventional pet food containers.

In a further embodiment, the present invention provides a method for improving the ability to display to consumers a pet food container comprising the steps of: providing a flexible pet food container having a substantially cuboid shape when filled with pet food and displayed to consumers; and providing the pet food container with handles that extend from a top surface of the pet food container until accessed by a consumer.

In an embodiment, the method includes the step of stacking a second flexible pet food container on the flexible pet food container when it is displayed to a consumer.

In another embodiment, the present invention provides a method for improving the design of a pet food container comprising the steps of: providing a pet food container that is constructed from a flexible material and includes handles; improving the filling characteristics of the container as compared to a similar conventional pet food container; improving the sealing characteristics of an opening of the container as compared to a similar opening in a conventional pet food container; and improving the stackability of the container as compared to the stackability of a similar conventional pet food container.

In an embodiment, the pet food container when filled has a cuboid design.

Additionally, the present invention provides a method of improving the filling characteristics of a pet food container comprising the steps of: providing the container with no side gussets allowing the container to be filled on conventional paper and plastic container filling equipment; providing the container with a mouth opening to allow for increased fill speeds as compared to a container with a smaller mouth opening; and providing the container with a bottom gusset to provide better container utilization as compared to a container including no bottom gusset.

Still further, in an embodiment, the present invention provides a method of improving the displayability of a pet food container comprising the steps of: providing a flexible pet food container that, when filled with a product, has a substantially cuboid shape allowing the container to be retailed standing up on a surface; providing on a wall of the container a display panel identifying the product; providing handles on the container that are visible to the consumer when the container is on the surface yet lay substantially flat on a surface of the container until accessed by the consumer; and providing the container with no side gussets.

In the method, various surfaces can be used including a shelf, a pallet, and a top surface of a second container.

Further, in an embodiment, a method for providing an improved pet food container is provided by the present invention comprising the steps of improving at least one of the filling, sealing, handling, transporting, and merchandising characteristics of a conventional pet food container by providing a container having a base portion including bottom side walls, and an interior, the side walls being defined by at least two sheets of flexible material sealed along two edges and defining two side seams located on opposite sides of the base, an upper panel portion having side panels that define a closure member wherein the upper panel portion extends below an upper end of the base portion, a pair of handles, and the pair of handles and upper panel are each sealed to the interior of the base portion.

Likewise, in an embodiment, a method for providing an improved pet food container is provided by the present invention comprising the steps of providing a base portion including a bottom, side walls, and an interior, the side walls being defined by at least two sheets of flexible material sealed along two edges and defining two side seams located on opposite sides of the base, an upper panel portion including side panels that define a resealable closure member, the upper panel defining a substantially flat surface when the container is in a closed position.

Accordingly, it is an advantage of the present invention to provide an improved flexible container.

A further advantage of the present invention is to provide an improved method for manufacturing containers.

Another advantage of the present invention is to provide a container that provides improved filling benefits for storing a variety of different products.

Furthermore, an advantage of the present invention is to provide a container that provides improved sealing benefits for storing a variety of different products.

Moreover, an advantage of the present invention is to provide a container that provides improved handling benefits for storing a variety of different products.

Further, an advantage of the present invention is to provide a container that provides improved transportation characteristics.

Another advantage of the present invention is to provide a container that provides improved merchandising characteristics.

Still, an advantage of the present invention is to provide a flexible container that provides for improved display of the container.

Moreover, an advantage of the present invention is to provide a flexible container that has improved characteristics for use with a pallet.

Furthermore, an advantage of the present invention is to provide a container that provides improved characteristics that are advantageous for use as a pet food container.

Additional features and advantages are described herein, and will be apparent from, the following Detailed Description and the figures.

DETAILED DESCRIPTION OF THE INVENTION

The present invention provides an improved container for housing products, method for manufacturing same, and methods of use of the container. The container is constructed from a flexible material, e.g., thin film of plastic, and has sufficient rigidity and strength to house and store a variety of products. Moreover, due to its construction, the container provides many design improvements and characteristics as compared to conventional containers, especially conventional pet food containers. As used herein, the term "conventional pet food container" or "conventional container" means containers for storing food products, including pet food, that were available and used prior to the inventions set forth herein. The background of the invention discusses some such containers. "Conventional process" means processes for manufacturing products that were used prior to the inventions set forth herein and that use or incorporate as a part thereof such conventional containers, e.g., filling the conventional container with product.

Figure 1:
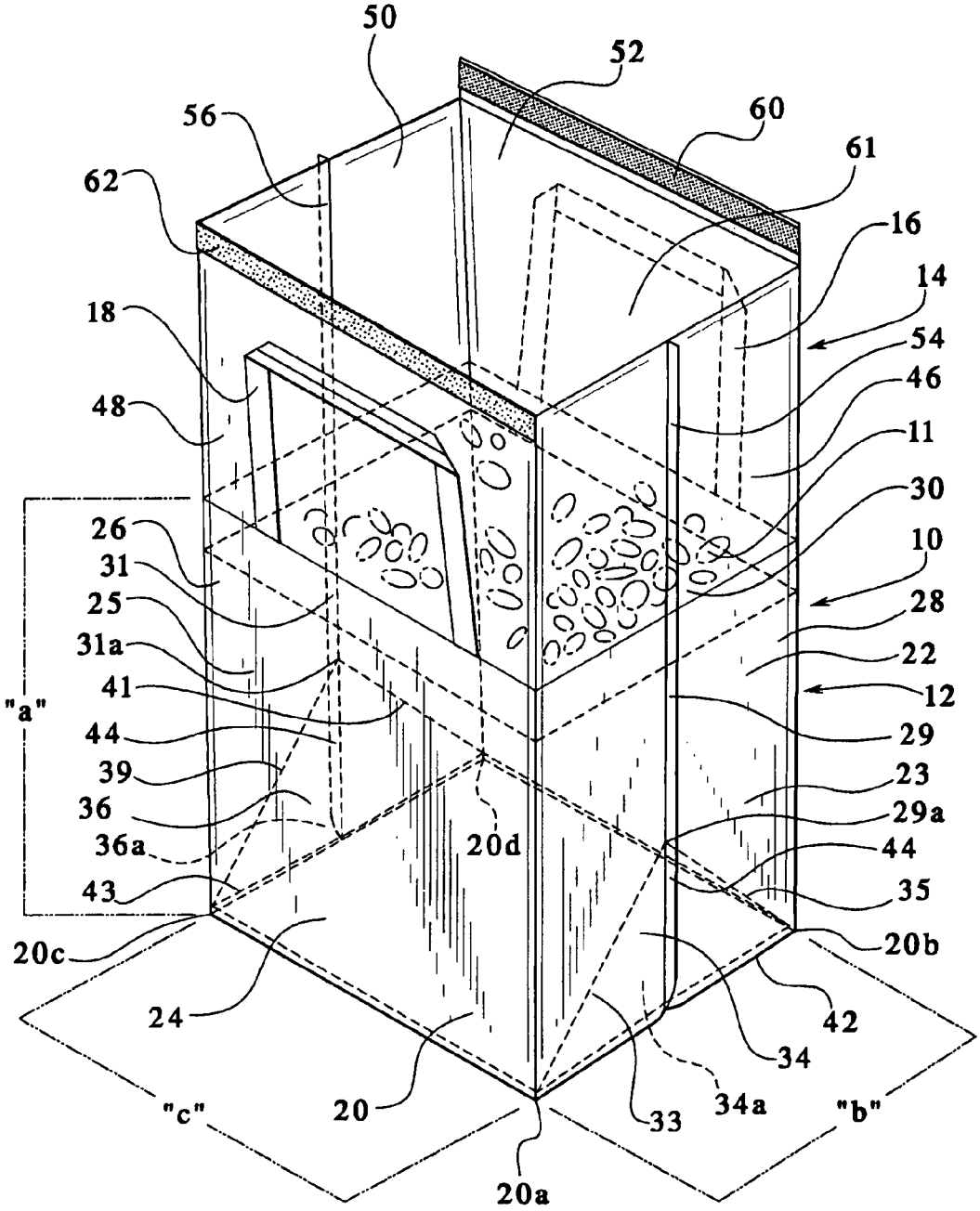
FIG. 1 illustrates a perspective transparent view of an embodiment of the container of the present invention filled with product prior to being sealed.
Figure 6:
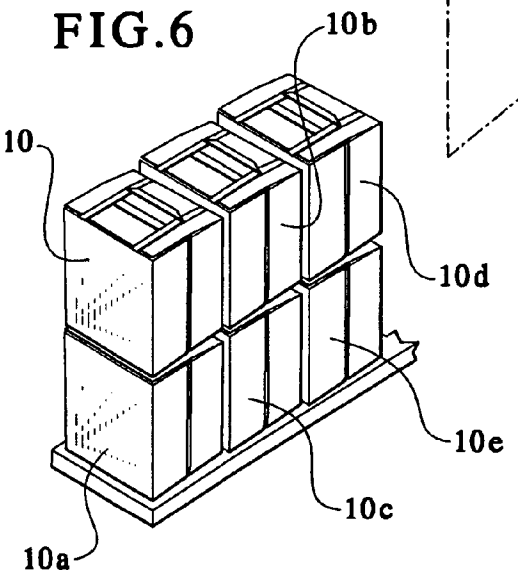
FIG. 6 illustrates a plurality of sealed/closed containers in a stacked position.
Figure 4:
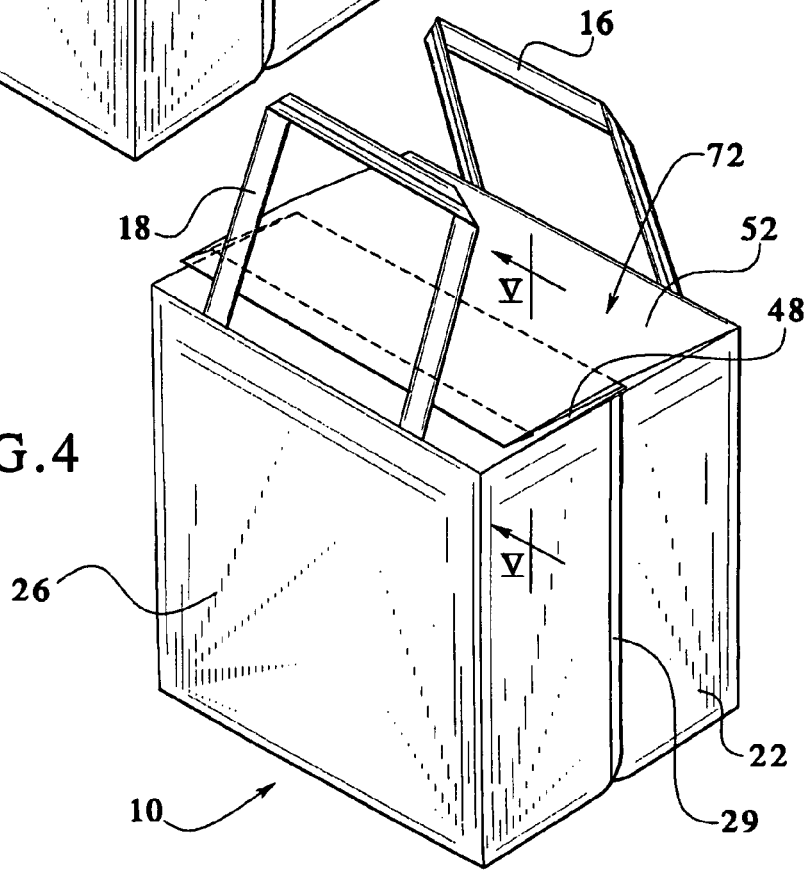
FIG. 4 illustrates a perspective view of the container in a sealed condition ready for storage.

FIG. 1 illustrates a transparent perspective view of an embodiment of a container 10 of the present invention. The container 10 is illustrated filled with product 111 and in an open condition. As illustrated in FIG. 4, in its sealed condition, the container 10 takes on, in a preferred embodiment, a cuboidal shape. The cuboid, e.g., cube-shape, of the flexible container 10 provides a container with greater stability when stored. Moreover, the cuboidal shape of the container 10 allows for vertical stacking of a number of filled containers as illustrated in FIG. 6. This allows for the display of the container/product at the point of sale, as well as provides a container affording ease of storage for the consumer and provides a more compact product for shipping and storage.

The container 10 has a substantially consistent cuboid appearance whether the container stands or is laid down. Due to its design, the container 10 takes up less space on a retail shelf or in a consumer's home. Moreover, the container 10 allows for better palletization. To this end, the container 10 provides a flatter surface for stacking. The container 10 design eliminates head space, thus, there is less entrapped air for more stable stacking.

Further, the design of the container 10 allows for upright methods of handling, transporting and displaying the container 10. This allows for an upright palletizing of the container 10. Further, the design provides a square container bottom that does not vary with product density. The container 10 footprint remains the same regardless of varying product density so the container 10 never overhangs the pallet sides. This reduces possible container 10 damage in distribution channels.

Due to the design, only the container 10 height changes with density, which only affects stacked product height. The container 10 design provides a container that will typically fit on store shelves which may have limited space. For example, in a shelf having a reduced width dimension. Additionally, the design allows the same number of containers 10 as conventional side gusseted bags can be located on a shelf.

The container 10 design allows it to be retailed standing upright. Thus, pallets of containers 10 can be displayable and shoppable at retail. By providing a large display panel on the front of container 10, it is easier for consumers to identify product brand on retail shelf. The design of the container 10 also provides handles that are always conveniently displayed on top of container 10 for easy removal of the container 10 from the shelf by the consumer.

Improved methods for palletizing containers 10 are also provided. In this regard, one can use column stacking with tie sheets to stabilize pallet. In addition, integrated stretch wrapper can be used in palletizer to stabilize the pallet. It is also possible to use a flat band conveyor to convey the containers.

Figure 2:
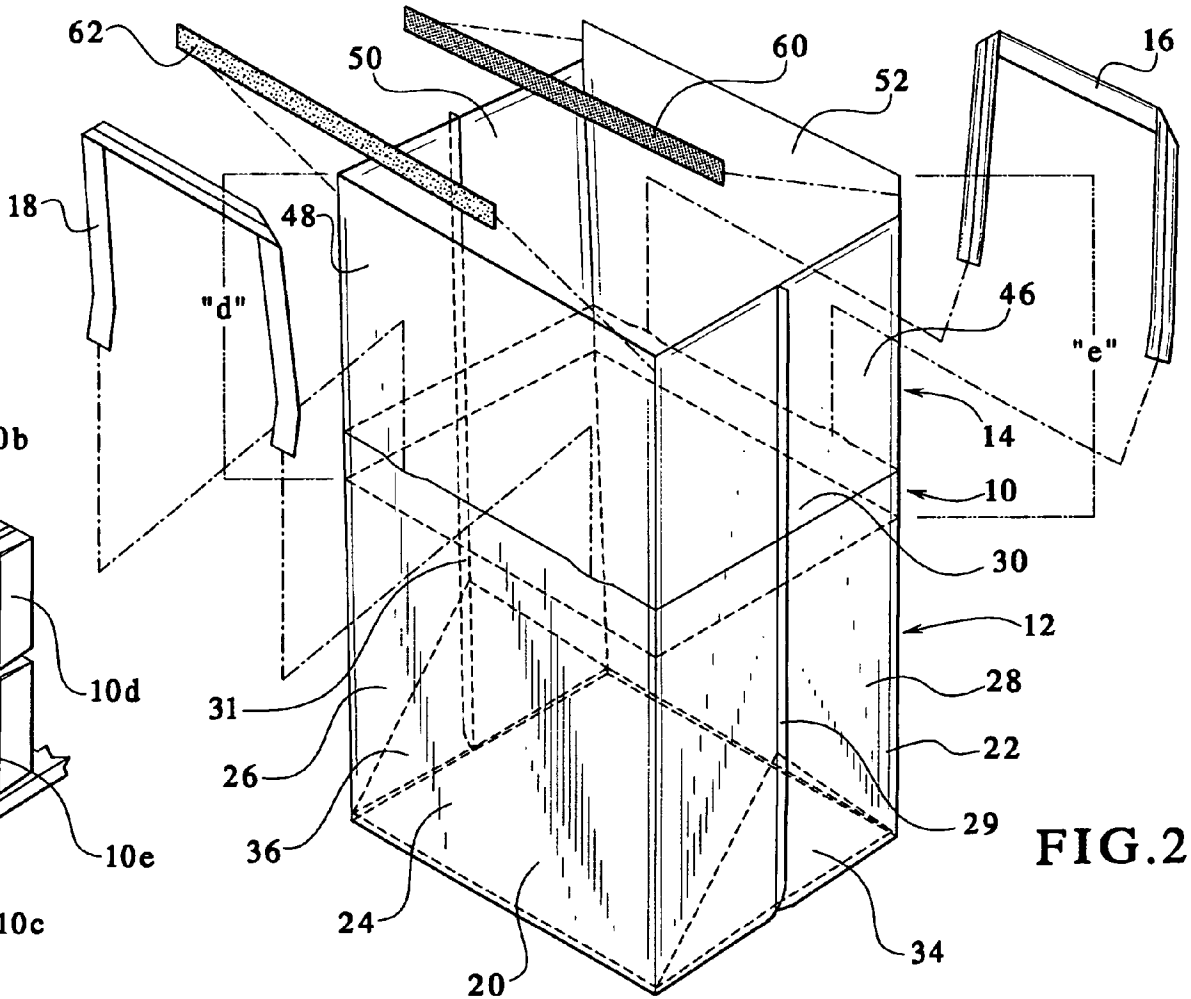
FIG. 2 illustrates a perspective transparent view illustrating separate components of the container prior to being bonded together.

Referring specifically to FIGS. 1 and 2, an embodiment of the container 10 is illustrated. Generally, the container 10 includes three main components: a base portion 12; an upper panel portion 14; and handles 16 and 18. As discussed below, these three components are sealed together to create the container 10. However, the handles are not essential to the formation of the container. As such, other embodiments of the present invention do not include handles.

The base portion 12 includes a bottom 20. The bottom 20 is constructed so that it defines a substantially flat planar surface. The bottom 20 therefore provides a surface that can support product 11 that is stored in the container 10. Moreover, the bottom 20 allows the container 10 to be supported on a flat surface providing stability to the filled container. In an embodiment, the bottom 20 is constructed from a rectangular sheet of material that is thermally sealed to a remaining portion of the base 12.

The base 12, in the preferred embodiment illustrated, includes four sides 22, 24, 26, and 28. The four sides 22, 24, 26, and 28, along with the bottom 20, define an interior 30 for housing product 11. In the preferred embodiment illustrated, the sides 22, 24, 26, and 28 of the base 12 are defined by two sheets of material sealed together along side seams 29 and 31. As illustrated, the side seams 29 and 31 are located on sides 22 and 26 of the base 12.

Triangular base sections or end walls 34 and 36 are formed at a lower portion 23, 25 of each side 22 and 26. Indeed, each of the triangular base sections 34 and 36 are defined by two sealed transitional side seams 33, 35 and 39, 41, respectively. The transitional side seams 33, 35 and 39, 41 extend from end corners 20*a*, 20*b* and 20*c*, 20*d* of the bottom 20 to a vertex 29*a*, 31*a* located along the side seams 29 and 31. Each triangular base section having a third side 42, 43 extending between end corners 20*a*, 20*b* and 20*c*, 20*d*, respectively. A lower side seam 44 extends unitarily from vertices 29*a* and 31*a* along side seams 29 and 31 to the third sides 42, 43. This structure results in the lower portions 23, 25 of the container sides 22 and 26 being reinforced along the seams 29 and 31. The resultant seams are free of the presence of the intersection of six converging sealing layers which tends to create capillary leakage as in prior containers. Further, this structure allows for good web control resulting in a highly efficient method of manufacturing containers.

Figure 7:
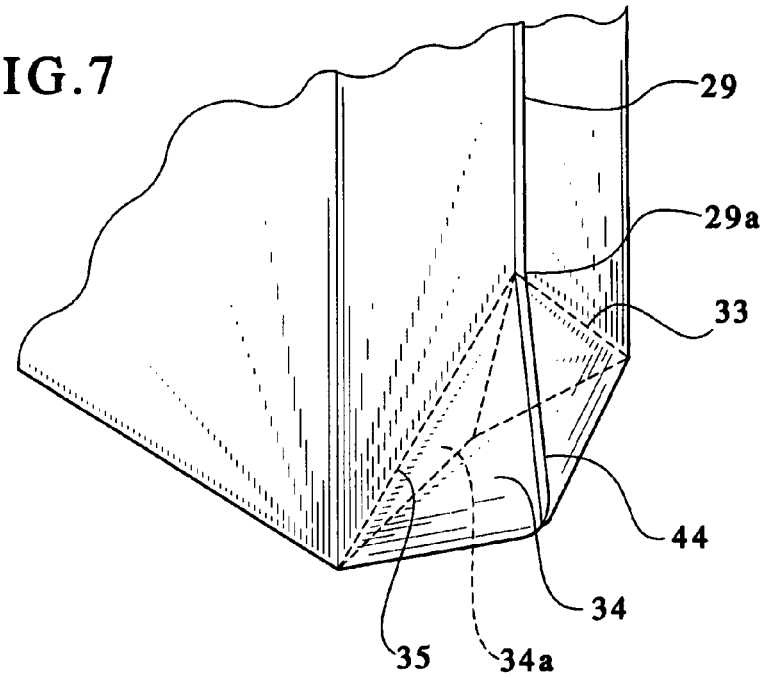
FIG. 7 illustrates a perspective bottom view of a section of the base portion incorporating the "hand-hold" cavity.

As shown in FIG. 7, the base 12 also includes interior triangular base sections 34*a* and 36*a* adjacent the exterior triangular sections 34 and 36. The interior and exterior triangular sections 34*a*, 34 and 36*a*, 36 are compressed together when the container is filled with product. Advantageously, the triangular sections are capable of forming a slightly conical or pyramid shape that provides a "hand-hold" cavity between the interior and exterior triangular sections. In this regard, the "hand-hold" cavity acts as another handle and allows the consumer to pick up the container for ease of pouring or scooping product from the container.

It should be noted, that the base 12 can have a variety of sizes and shapes. For example, for a container 10 designed to house 18 pounds of dry product, e.g., cat food, in a preferred embodiment, the base has a height "a" of approximately 12 inches, sides 22 and 26 have a width "b" of approximately 7 inches, and sides 24 and 28 have a width "c" of approximately 12 inches. For a container designed to house 20 lbs of dry product, e.g., dog food, in a preferred embodiment the base has a height "a" of approximately 12¼ inches, sides 22 and 26 have a length "b" of approximately 9 inches, and sides 20 and 24 have a length "c" of 12 inches.

The base 12, as well as the remaining portions of the container 10, are preferably made of a thin plastic material. For example, the container base 12 can be made from a two-ply construction consisting of a layer of heat sealable polyethylene and a layer of imprintable polyester. Though both layers may be polyethylene. By way of example and not limitation, the material used to construct the container 10, and therefore the base 12, can include a polyethylene ply of 2½ mils and a polyester layer of ½ mil.

Preferably, the container 10 includes two handles 16 and 18. The handles 16 and 18 provide grasping members for carrying the container 10 either prior to the container being filled or after it is filled. Of course, the handles 16 and 18 can take on a variety of shapes and sizes. Moreover, the handles 16 and 18 can be manufactured from a variety of materials suitable for variable load strengths. In a preferred embodiment, the handles 16 and 18, prior to being secured to the container, have a length of 17 inches and are 2-ply thick. In this regard, they are constructed from a web of film that is folded over on to itself to increase the strength of the handles. To this extent, the handles 16 and 18 can be constructed from a single sheet of plastic film.

As illustrated in FIGS. 1 and 2, the container 10 includes an upper panel portion 14. The upper panel portion includes four sides 46, 48, 50, and 52. The upper panel 14, similar to the side wall portion 22, 24, 26, and 28 of the base 12, is constructed from two sheets of material sealed along two seams 54 and 56. In a preferred embodiment, the seams 54 and 56 of the upper panel are in alignment with side seams 29 and 31 of the base 12 when the upper panel 14 is secured to the base 12. In the container 10 illustrated in FIG. 1, the upper panel defines an opening 61 that affords access to the interior of the container 10.

Preferably one of the sides 52, of the upper panel 14, has a length that is slightly greater than that of the other sides 46, 48, and 50. In the illustrated embodiment, this side 52 includes a closure member 60 for assisting in sealing the container 10. The closure member 60 is designed to be secured to a corresponding closure member 62 on side 48.

For example, in the embodiment illustrated, side 52 includes a hook and loop strip 60 that mates with a corresponding hook and loop strip 62 on side 48. This allows the container 10 to be closed and opened in an easy manner. Thus, initially the container 10 can be filled with product 11 through the opening 61 and closed by the closure members 60 and 62. The consumer can then access product through the opening 61 and reclose the container 10 by using the closure members 60 and 62. It should, however, be noted that a variety of closure means and members can be used. For example, the closure can include a zipper, a ziplock or slider structure, or an adhesive or cohesive member.

As previously noted, preferably the upper panel 14 as well as the handles 16 and 18 are constructed from a different material than the base 12.

Similar to the base, the upper panel 14 can have a variety of sizes and shapes. For example, for a container 10 designed to hold 18 lbs of dried products, referring to FIG. 2 in a preferred embodiment of the container 10, the sides 48, 50, and 54 of the upper panel 14 have a length "d" of approximately 7⅜ inches, and side 52 has a length "e" of approximately 8½ inches. The width of the sides of the upper panel 14 will correspond to the width of the corresponding sides of the base 12. For a container 10 designed to hold 20 lbs. of dry product, length "d", in a preferred embodiment, will be approximately 9⅝ inches and length "e" approximately 10¾ inches.

The upper panel 14 is designed to be received within the base 12. In a preferred embodiment, at least approximately 1 inch of the upper panel 14 is received within the base 12. The upper panel 14 is then preferably heat sealed to the base 12. It has been found that a heat seal of at least 1 inch provides a sufficiently strong connection between the upper panel 14 and base 12.

In constructing the container 10, the handles 16 and 18 are preferably received between the upper panel 14 and the base 12. The base 12 is then thermal sealed to the upper panel 14 with the handles 16 and 18 being sealed therebetween. Specifically, the pair of handles 16 and 18 and the upper panel 14 are each thermally sealed unto themselves and to the interior of the base 12. The interior side of the upper panel has a different sealant layer of polyethylene designed for sealing the interior of the containers, yet, allowing ease of opening the container. This provides a sufficiently strong structure as well as one that allows the weight of the contents to be evenly distributed over the base 12. Further, such a structure allows the closure member 60 and 62 located on the upper panel 14 to be closed.

As a result, the base portion 12, the upper panel 14 and the handles 16 and 18 are thermally bonded forming a hermetically sealed interior.

Moreover, the upper panel 14 can be manufactured from a non-slip plastic material. The non-slip plastic material allows the containers to be stacked vertically with limited slippage between the top and bottom containers.

Figure 3:
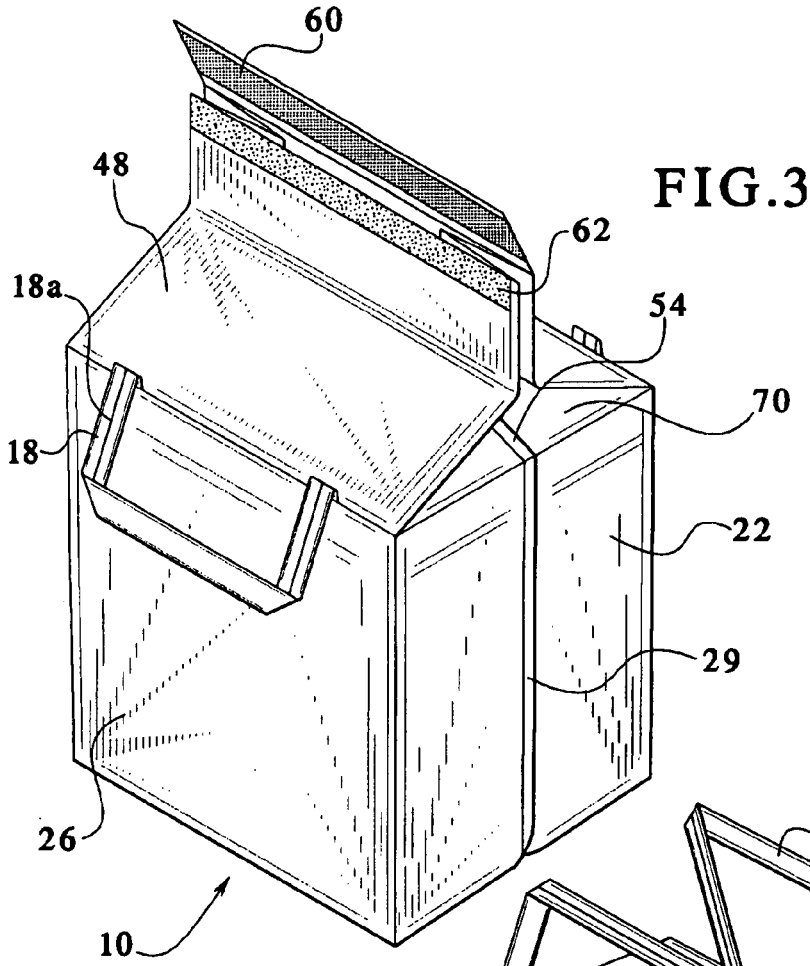
FIG. 3 illustrates a perspective view of the container just prior to the closure members being sealed.
Figure 5A:
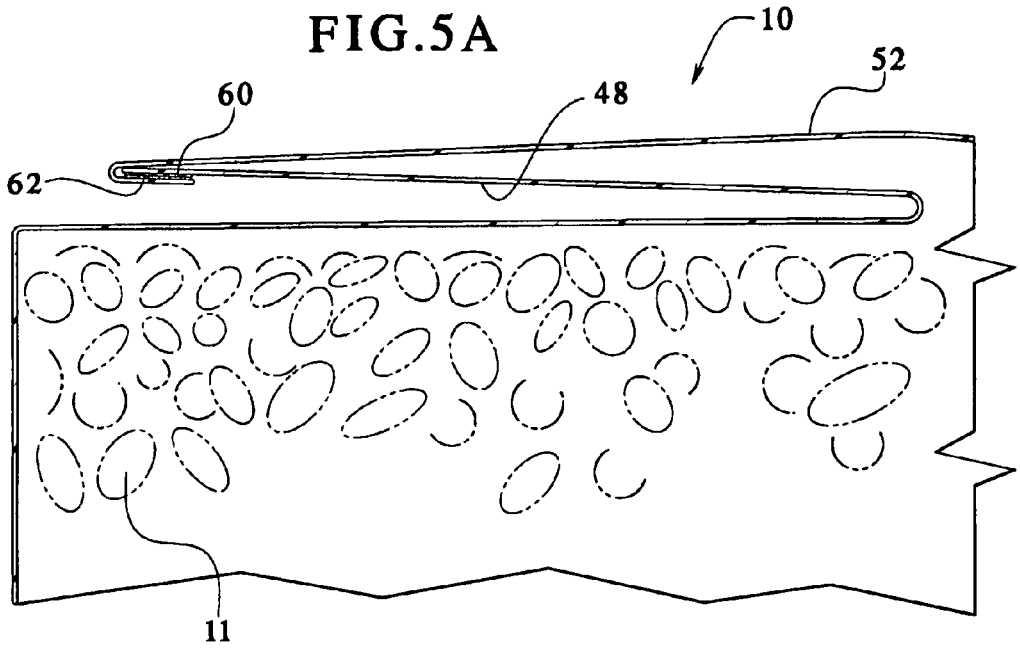
FIG. 5A illustrates a cross-sectional view of the container taken along lines V-V of FIG. 4.

FIGS. 3, 4, 5A and 5B illustrate how the container 10 can be closed. As illustrated in FIG. 3, first the closure members 60 and 62 are secured to each other. When so secured, sides 46 and 50 fold inward to create triangular portions 70. Sides 48 and 52 are then folded over and down onto side 48 as illustrated in FIGS. 4 and 5A. The method of folding the sides in this manner creates a flat top surface 72. Generally, the length of the excess material of the sides 48 and 52 extending from the fold to the closure members may vary depending on the density of the product. Indeed, if the product is very dense then the product will take up less space within the container and vice versa. After the sides of the container are folded down, the sides 48 and 52 are tapped down along the outer fold to further seal the container 10.

Figure 5B:
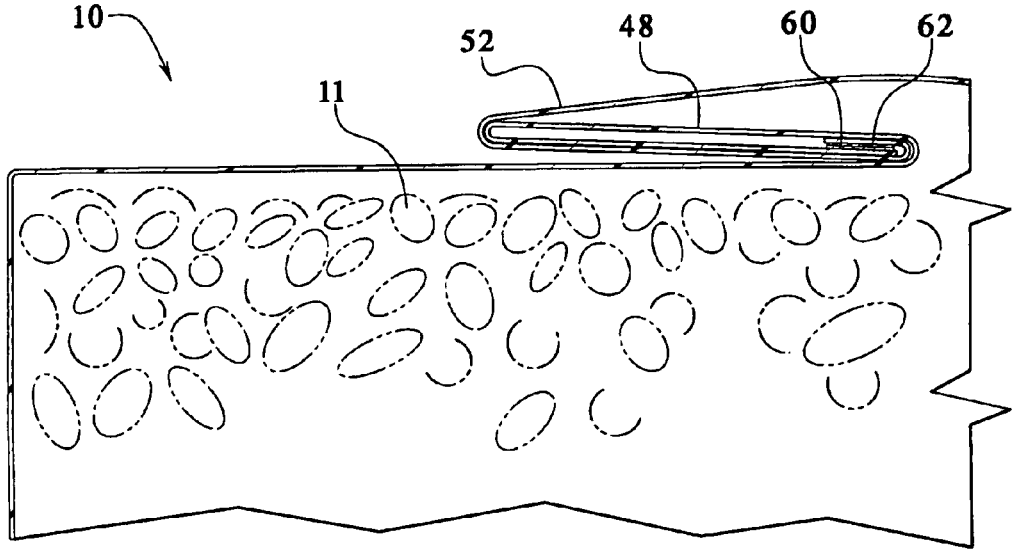
FIG. 5B illustrates a cross-sectional view of an alternative embodiment of the container of FIG. 4 taken along V-V.

Alternatively, FIG. 5B illustrates another way the container can be folded and closed to create the desired flat top surface 72. Specifically, the method shown in FIG. 5B incorporates a double fold in which the sides 48 and 52 are folded twice. The double fold adds even more strength to the top of the container and isolates the closure members 60 and 62.

Once so closed, the container 10 takes on a substantially cubic-shape as illustrated in FIG. 4. The flat bottom 20 and flat top surface 72 allow multiple containers 10, 10*a*, 10*b*, 10*c*, 10*d*, and 10*e* to be stacked vertically or otherwise stored or transported as illustrated in FIG. 6.

Container 10 of the present invention due to its structure also has anti-burst characteristics which are an improvement over those in the prior art. In prior art containers, the dropping of same causes the sides to expand upon impact. This expansion or swell is directly transferred to the inner section of the seams being pulled in the opposite directions. This often results in a breach of the container.

In the present invention, the side seams 29 and 31 of the container 10 extend to the lower side seams 44 which are formed from the transitional seams 33, 35 and 39, 41. As such, should the container be dropped or otherwise caused to expand, the majority of the oppositely disposed forces are placed upon the lower side seam. Thus, should these forces cause one or both of the lower side seams to be pulled apart, this action does not cause a breach in the portion of the container containing the product, whether it be solid pellets or a liquid.

Other embodiments of the invention include containers of various shapes and sizes. For example, a container can be substantially triangular in shape. In this example, the container includes a flat bottom and two sides sealed together. However, the top portion folds down but is not flat as in a cubic-shaped container.

In an embodiment, the method of making the container involves a web roll process that results in a flat blank portion and a forming process that forms the base portion 12 and seals the base portion together. The result being a substantially flat container. After the web roll and forming processes, the flat containers are ready to be erected, filled with product, and sealed closed. Advantageously, the flat containers can be shipped to the manufacturing plant or distribution center where they are erected, filled with product and sealed closed. Of course, the erecting, filling and sealing of the containers can take place at the same location as the web roll and forming processes.

Figure 8:
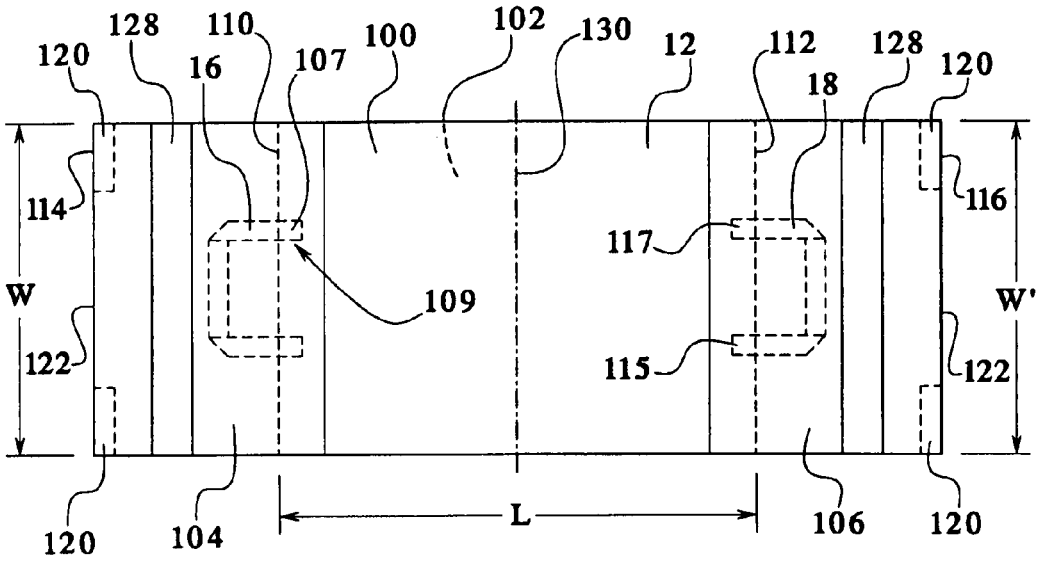
FIG. 8 illustrates a perspective view of a flat blank of the container during the manufacturing process.

Turning to FIG. 8, in the web roll process, a master web roll of plastic material provides the base portion 12. As mentioned earlier, the plastic material is a two-ply construction consisting of, for example, a layer of heat sealable polyethylene and a layer of imprintable polyester.

As the web roll unrolls, a flat sheet of plastic having a width that is approximately a length L of the base portion 12 is provided. This flat sheet may extend for hundreds of feet in length as it is indexed in a progressive mode along the process.

In general, the progressive mode of the process indexes the flat sheet forward at intervals that are at least a width W of the base portion 12. In this example, the polyethylene side (ultimately the interior of the container) of the flat sheet is facing up or on a front side 100 while the polyester side (ultimately the exterior of the container) is facing down or on a back side 102 during the process.

As the flat sheet is indexed the width W of the container, the premade handles 16 and 18 are introduced and thermally bonded at each of the front (polyethylene) side 100 of the base portion 12.

The handles 16 and 18 are also manufactured from a flat sheet of plastic having a width of approximately two inches. (See, e.g., handle 18 in FIG. 3.) Like the flat sheet for the base portion 12, the flat sheet for the handles may also be provided from a web roll. As the flat sheet is unrolled from the web roll, each end of the width of the flat sheet is folded into the center partially overlapping each other so that a seam 18*a* exists down the middle. The seam is then thermally bonded, resulting in a ribbon-like strip. The ribbon is cut to the desired length of the handle. At this time, handles 16 and 18 are each shaped into a U-shape as shown in FIG. 8.

After the handles 16 and 18 are bonded to the base portion 12, the flat sheet is indexed again for the introduction of a left panel 104 and a right panel 106. The panels 104 and 106 will eventually form the upper panel portion 14 of the container. Each of the panels 104, 106 is positioned in line with the width W of the base portion 12. Each panel 104, 106 overlaps a side 110, 112 of the flat sheet. The panels 104, 106 are then thermally bonded to the flat sheet and a side 107 of the handle that is opposite to a handle side 109 that was previously bonded to the base portion 12. In this regard, a hermetic seal is formed due to the bonding process. Additionally, another sealant can be applied at each end 115, 117 of the handles 16 and 18. In this example, the sealant encircles the ends 115, 117 of the handles prior to the introduction of the panels 104, 106.

Next, the flat sheet is indexed forward again. At this point, the closure members 60, 62 (not shown in FIG. 8) can be applied and thermally bonded to the free ends 114, 116 of the left and right panels 104, 106, respectively.

Sections 120 of the free ends 114, 116 are cut-out to form flaps 122. The flaps 122 are designed to be folded one over the other for the closure of the container. As such, the cutout sections 120 may vary depending on the type of closure member that will be used for the container.

In addition, a thin sealant 128 may be applied as a peel seal to the left and right panels 104, 106. Specifically, the thin sealant extends along a width W of the panels 104, 106. The peel seal is a temporary seal that is opened by the user of the product when the user opens the container.

At this point, the flat blank portion continues on to the forming process. Alternatively, the flat blank portion can be formed at a later time or at a different location. In this regard, the flat blank portion is rolled onto a large spindle-type web roll or layered back and forth and placed into a container for storage and shipping.

Generally, the forming process includes forming the base portion of the flat blank, sealing the base portion together and, if desired, folding the bottom of the base portion together so that the container is, once again, substantially flat for shipping or storage. By way of example, U.S. patent application Ser. No. 09/467,125 filed on Dec. 20, 1999, incorporated herein be reference, discloses a manufacturing technique that can be used to form the base portion of the containers of the present invention.

Specifically, the flat blank is indexed forward. As it moves forward, the flat blank is drawn over a v-shaped forming plow and through two rollers causing the flat blank to be folded in half down a center line 130 of the base portion 12 forming a web fold. The resultant folded portion has first and second layers. The first and second layers each have a bottom portion located adjacent the web fold.

Cutouts are formed in the bottom portion of each layer at spaced intervals that extend from each side of the web fold. An upper portion of the first and second layers are heat sealed together forming the eventual side seams 29 and 31 of the finished container 10. The ends of the side heat seals are spaced from and aligned with the cutouts. The bottom portions of the first and second layers are folded upon themselves into two bottom folds. The bottom portions have sections aligned with the upper portion side seals. The bottom portion aligned sections are heat sealed together to form side seal extensions. An area of the bottom portions are heat sealed together adjacent the side seal extensions. The formed flat blank is then severed along the side seals and side seal extensions resulting in individual containers.

As described above, the flexibility of the container 10 of the present invention is advantageous because it can be initially manufactured as a flat structure. To this end, numerous containers can be condensed in a flat, compact state for shipping on pallets, etc., to a second manufacturing plant or distribution center for erecting and filling with product. During this step, the interior cavity 61 of the container 10 is erected, filled with product, sealed, and shipped to the point of purchase or storage.

The container 10 design provides many filling and sealing benefits. Because the container 10 has side gussets, this allows the container to be easily transported, gripped and filled on conventional premade paper and plastic container filling equipment. By providing the container 10 with a wider opening for larger fill spouts, this provides for increased fill speeds.

Due to the bottom gussets, the container 10 opens easier for better container volume utilization (versus side gusseted containers that tend not to open up completely). The container 10 design allows them to lie flatter allowing a greater number of containers to be stacked on the filling machine. This allows the use of simpler less expensive smooth sealing jaws (e.g., not profiled to accommodate different material layer thicknesses) to hermetically seal the bag top. The container 10 also allows the handles to be folded and tacked down keeping the long strap handles out of the way of filling machine grippers, transfer belts and sealers.

The design of the bottom of the container 10 also facilitates filling of the container 10. For example, the flat bottom design of the container allows product to fill the bag more completely and quicker because the container 10 opens up faster when filling.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

What is claimed is:

1. A method of manufacturing a container, the method comprising:

unrolling a flat sheet of a master web roll of a plastic material;

thermally bonding a pair of handles to a front side of the flat sheet;

indexing the flat sheet to form a plurality of panels on the flat sheet; and cutting and sealing the flat sheet to form a flexible container comprising 1) a base portion including a bottom, side walls, and an interior, the side walls being defined by at least two sheets of flexible material sealed along two edges and defining two side seams located on opposite sides of the base, the base including two triangular portions each triangular portion extending from the bottom to a side seam, and 2) an upper panel portion, that is designed to be received within the interior of the base portion and includes side panels that define a closure member, wherein the pair of handles and upper panel are thermally sealed to the interior of the base portion.

2. The method of claim 1 wherein the container has a flat bottom.

3. The method of claim 1 wherein the container has a bottom gusset.

4. The method of claim 1 wherein the container does not have side gussets.

5. The method of claim 1 further comprising providing the container with the ability to be sealed using a smooth sealing jaw during the manufacturing process.

6. The method of claim 5 wherein the ability to be sealed with smooth jaws is achieved, at least in part, by providing the container with a relatively consistent material thickness.

7. The method of claim 1 wherein the container in an unfilled condition is so constructed and arranged so that a plurality of containers lay flatter on a filling machine than a similar number of conventional containers.

8. The method of claim 1 wherein the container is a food container.

9. The method of claim 8 wherein the pet food container is a flexible container.

10. The method of claim 1 wherein the container is a pet food container.

* * * * *